United States Patent [19]

Berger

[11] Patent Number: 4,563,687

[45] Date of Patent: Jan. 7, 1986

[54] ADJUSTABLE ANTENNA MOUNT

[75] Inventor: Eric V. Berger, Brookline, Mass.

[73] Assignee: GTE Communications Products Corporation, Waltham, Mass.

[21] Appl. No.: 577,443

[22] Filed: Feb. 6, 1984

[51] Int. Cl.[4] ..... H01Q 1/12; H01Q 3/02

[52] U.S. Cl. ..... 343/882; 343/765; 248/183

[58] Field of Search ..... 343/878–882, 343/892, 765, 762, 757, 761, 763, 766; 248/183, 274, 284, 278

[56] References Cited

U.S. PATENT DOCUMENTS

| | | | |
|---|---|---|---|
| 3,714,660 | 1/1973 | Scrafford et al. | 343/880 |
| 4,086,599 | 4/1978 | Vander Linden, Jr. et al. | 343/881 |
| 4,475,110 | 10/1984 | Hutchins | 343/882 |

FOREIGN PATENT DOCUMENTS

| | | | |
|---|---|---|---|
| 54-37661 | 3/1979 | Japan | 343/882 |

*Primary Examiner*—Eli Lieberman
*Assistant Examiner*—Michael C. Wimer
*Attorney, Agent, or Firm*—J. Stephen Yeo

[57] ABSTRACT

An antenna mount includes a mounting plate which holds an antenna such as a microwave horn. The mounting plate is connected by a hinge to a baseplate. The angle of the mounting plate with respect to the baseplate is controlled by an adjustable brace extending between the antenna mounting plate and a bracket, allowing adjustment of elevation. The baseplate is pivotally mounted on a mechanical ground allowing independent adjustment of azimuth.

1 Claim, 1 Drawing Figure

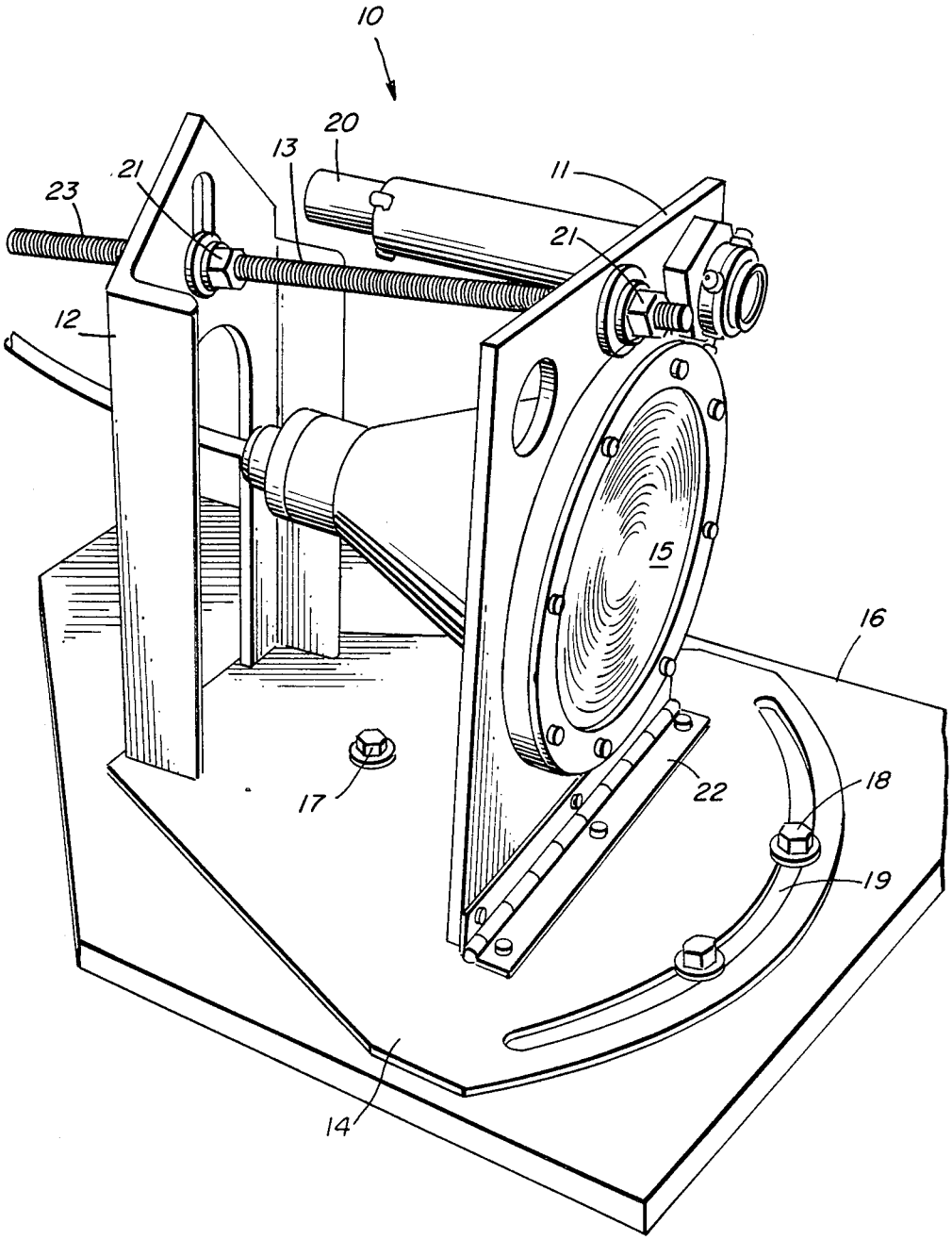
10
20
13
11
21
23
21
12
15
16
17
22
18
19
14

ADJUSTABLE ANTENNA MOUNT

BACKGROUND OF THE INVENTION

This invention pertains to antenna mounts and more particularly is concerned with antenna mounts with provisions for azimuth and elevation adjustments.

In certain applications such as radar test ranges and microwave repeating stations, it is desirable to have an adjustable mount for holding an antenna such as a microwave horn antenna in a fixed position after adjustment. It is important that such a mount be rugged yet relatively inexpensive.

Antenna mounts are known which have an antenna mounting plate supported by a plurality of adjusting screws.

Adjustment of either azimuth or elevation may affect the alignment of the other parameter due to bending forces on the antenna mounting plate. Furthermore, if the antenna mounting plate is cantilevered, it is subject to vibrations.

The object of the present invention is to provide a simple, thus inexpensive, rugged antenna mount with independent adjustments of azimuth and elevation.

BRIEF DESCRIPTION OF THE DRAWING

The single drawing is a view of an adjustable antenna mount which embodies the invention.

DESCRIPTION OF THE INVENTION

Referring to the drawing, an adjustable antenna mount 10 includes an antenna mounting plate 11, a bracket 12, an adjustable brace 13, and a baseplate 14. The antenna mounting plate 11 is adapted to hold an antenna 15 by screws, clamps, or other securing means. A microwave horn antenna is illustrated as an example.

Antenna mounting plate 11 is coupled to baseplate 14 by a hinge 22 running along one edge of the antenna mounting plate. Antenna mounting plate 11 can pivot about hinge 22 if not restrained. Bracket 12 is welded or otherwise affixed to baseplate 14 at a location behind the antenna mounting plate 11. Adjustable brace 13 extends between bracket 12 and mounting plate 11. Brace 13 may be a threaded rod 23 with two nuts 21 on both ends to enable the effective length of brace 13 to be changed. Holes in the bracket and antenna mounting plate are provided to accommodate the brace.

The angle of the mounting plate 11 (and the antenna it carries) with respect to the baseplate 14 is adjusted by varying the effective length of brace 13.

The baseplate 14 is pivotally mounted to a mechanical ground plate 16. The mechanical ground may be a larger plate tapped to accept screws 17, and 18. Screw 17 extends through a clearance hole in baseplate 14. Baseplate 14 (and thereby the antenna) may rotate on mechanical ground plate 16. Screw 18 extends through an arc-shaped slot 19 in the baseplate 14, and when tightened locks the baseplate flat 14 in relation to the mechanical ground plate 16.

As a feature of the invention, the antenna mounting plate 11 may carry an optical telescope 20 which is aligned to correspond to the beam of antenna. Telescope 20 may be used to rapidly aim the antenna.

Azimuth and elevation positions of the antenna 15 are independently adjustable. Assuming baseplate 14 is horizontally disposed, elevation is adjustable by changing the length of brace 13 and tilting the antenna mounting plate 11. Azimuth is adjusted by rotating baseplate 14 on mechanical ground 16. When the adjusting members are tightened, i.e., nuts 21 and screws 17, 18, the antenna mount is very stable and rugged.

The described antenna mount is just one embodiment of the invention, the scope of which is defined by the claims.

I claim:

1. An antenna mount allowing independent adjustment of azimuth and elevation, comprising;

(a) a mechanical ground plate having a threaded hole;

(b) a baseplate adapted to rotate on said mechanical ground plate, said baseplate having an arc-shaped slot;

(c) an antenna mounting plate adapted to hold an antenna;

(d) a hinge coupling an edge of said antenna mounting plate to said baseplate;

(e) a bracket affixed to said baseplate;

(f) an adjustable brace extending between said bracket and said antenna mounting plate for holding said antenna mounting plate in relation to said baseplate; and (g) a bolt extending through said arc-shaped slot into said threaded hole for locking said baseplate to said mechanical ground plate.

* * * * *